US007458476B2

(12) United States Patent
Peoples et al.

(10) Patent No.: US 7,458,476 B2
(45) Date of Patent: Dec. 2, 2008

(54) TILTED REACTOR CORE STACKING TABLE SYSTEM AND METHOD

(75) Inventors: Stuart Allen Peoples, La Grange, NC (US); Stephen Bryant Ham, Goldsboro, NC (US)

(73) Assignee: Waukesha Electric Systems, Inc., Waukesha, WI (US)

( * ) Notice: Subject to any disclaimer, the term of this patent is extended or adjusted under 35 U.S.C. 154(b) by 751 days.

(21) Appl. No.: 10/951,768

(22) Filed: Sep. 29, 2004

(65) Prior Publication Data

US 2006/0102568 A1 May 18, 2006

(51) Int. Cl.
*A47F 5/00* (2006.01)

(52) U.S. Cl. ..... 211/134; 211/175; 211/41.15

(58) Field of Classification Search ..... 211/187, 211/134, 206, 193, 175, 207, 209, 41.15, 211/60.1, 70.4; 248/529, 149, 395, 397, 248/157, 133, 136, 140, 142, 148, 346.06, 248/371, 398
See application file for complete search history.

(56) References Cited

U.S. PATENT DOCUMENTS 3,235,212 A * 2/1966 Baumiller, Jr. ..... 248/142
4,278,386 A * 7/1981 Eranosian ..... 414/421
4,667,917 A * 5/1987 Takace ..... 248/398
4,886,233 A * 12/1989 Bateman et al. ..... 248/647
5,037,047 A * 8/1991 Chanko ..... 248/140
5,044,505 A * 9/1991 Spratt ..... 211/22
5,238,146 A * 8/1993 Thorne, Jr. ..... 222/1
5,496,088 A * 3/1996 Stewart ..... 296/65.03
5,927,514 A * 7/1999 Linder ..... 211/26
5,950,846 A * 9/1999 Duane ..... 211/175
6,390,309 B1 * 5/2002 Tucker ..... 211/85.7
6,401,941 B1 * 6/2002 Maumus ..... 211/59.1
6,571,963 B2 * 6/2003 Humphrey et al. ..... 211/13.1
6,814,023 B1 * 11/2004 Foster ..... 116/28 R
2005/0279720 A1 * 12/2005 Blincoe ..... 211/41.15
2006/0192070 A1 * 8/2006 Chan ..... 248/371

* cited by examiner

*Primary Examiner*—Jennifer E. Novosad
(74) *Attorney, Agent, or Firm*—Baker & Hostetler LLP

(57) ABSTRACT

A movable fixture onto which core laminates may be stacked in a manner such that the laminates are secure and easily accessible, and the fixture may be used to transport the laminates. The fixture consists of, among other things, a stacking table that has at least one pivot arm extending therefrom and a base plate that has at least one appendage extending therefrom. The pivot arm is movably and removably attached to the appendage in order to permit the stacking table to move between a transporting position and an assembling position.

11 Claims, 4 Drawing Sheets

TILTED REACTOR CORE STACKING TABLE SYSTEM AND METHOD

FIELD OF THE INVENTION

The present invention relates generally to a fixture for accomplishing a manufacturing process. More particularly, the present invention relates to an apparatus and method for assembling laminated reactor cores.

BACKGROUND OF THE INVENTION

It is known in laminate reactor core manufacturing to use a mounted fixture when stacking individual laminates. The fixture is horizontally arranged such that the individual laminates are stacked vertically, one on top of another, within the fixture. A disadvantage of the horizontally mounted fixture is that once the laminates are stacked, a core clamping assembly must be assembled to the laminate reactor core before it can be safely removed from the mounted fixture and then transported to the next assembly position. Often times, the clamping assembly has to be disassembled upon the laminate reactor core's arrival at the next assembly position. Assembling and then disassembling the clamping assembly is time consuming and, therefore, results in added costs to the laminate reactor core manufacturing process.

Accordingly, there has been a long standing need for a movable fixture apparatus and method onto which individual laminates may be stacked in a manner such that the laminates are easily accessible, and the fixture apparatus may be used to transport the laminates.

SUMMARY OF THE INVENTION

The foregoing needs are met, to a great extent, by the present invention, wherein in one aspect an apparatus is provided that in some embodiments a movable fixture onto which individual laminates may be stacked in a manner such that the laminates are easily accessible, and the fixture apparatus may be used to transport the laminates.

In accordance with one aspect of the present invention, an apparatus for handling laminates is provided. The fixture consists of, among other things, a main support member that has at least one pivot arm extending therefrom and a base plate that has at least one appendage extending therefrom. Where the pivot arm has a first end and a second end, and the first end is movably and removably attached to the appendage in order to permit the stacking table to move relative to the base plate.

In accordance with another aspect of the present invention, a method for handling laminates is provided. The method comprises providing a fixture, locating the fixture in an assembling position, stacking laminates onto the fixture, and transporting at least a portion of the fixture, wherein the laminates are contained within the portion of the fixture during transport.

In accordance with yet another aspect of the present invention, an apparatus for handling laminates is provided. The apparatus includes means for supporting the laminates and means for securing the means for supporting. Wherein, the means for supporting is movably and removably attached to the means for securing.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
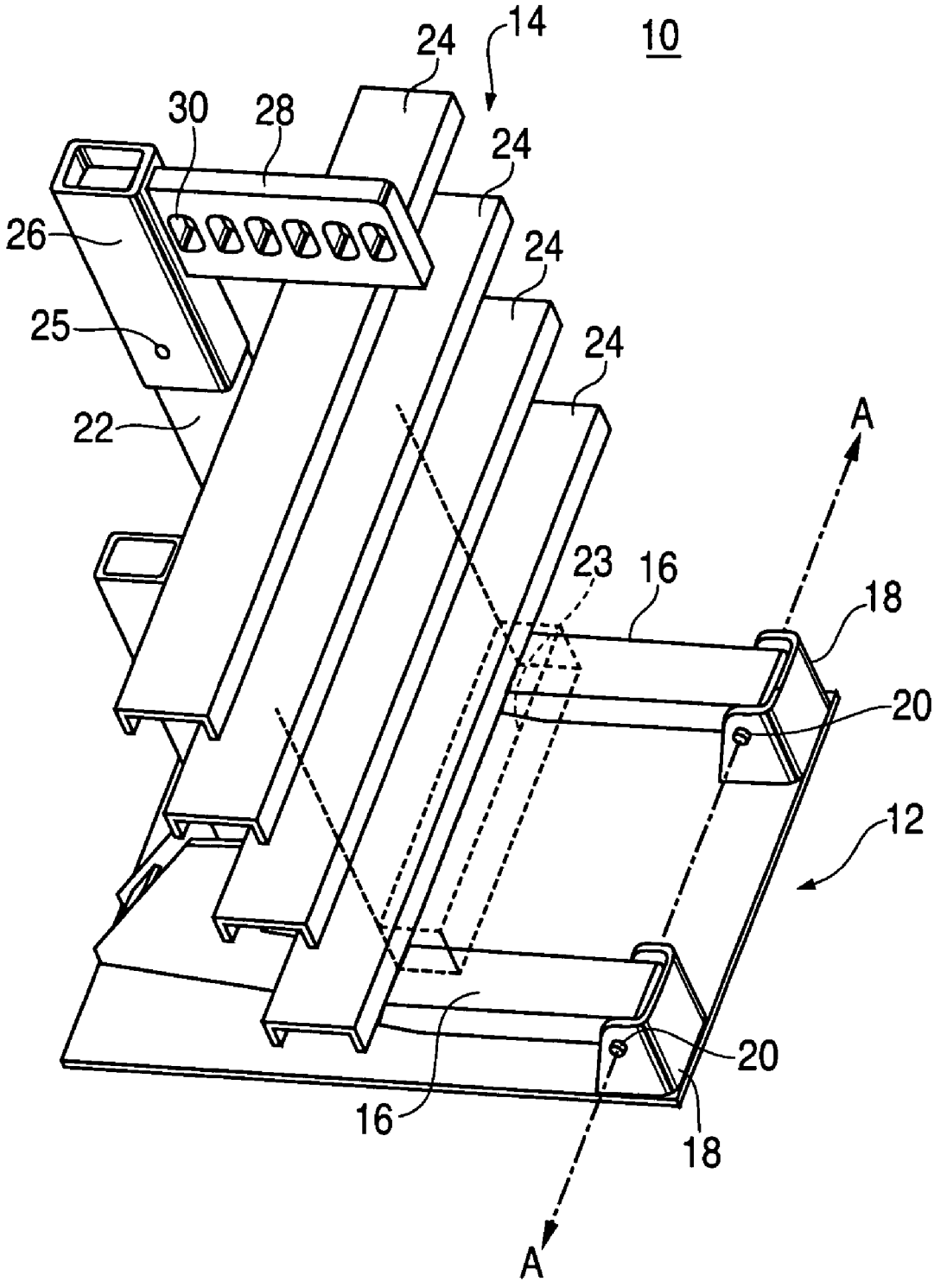
FIG. 1 is a perspective view illustrating an exemplary fixture for handling laminates according to a preferred embodiment of the present invention.

The invention will now be described with reference to the drawing figures in which like references numerals refer to like parts throughout. In accordance with some embodiments of the present invention, a movable fixture and method of use thereof is provided for assembling and transporting core laminates. In various exemplary embodiments, a portion of the fixture is tilted slightly from vertical, such that gravity utilizes the laminates' weight to create securing forces in both the horizontal and vertical directions. These horizontal and vertical forces, secure the laminates in the fixture without additional support from securing devices, such as straps, tie-downs, or clamping assemblies, during stacking. Since the fixture is slightly tilted, rather than completely horizontal, the fixture presents the laminates in a position from which they are easily handled, arranged, and stacked.

Once the core laminates are properly stacked, the tilted portion which contains the stacked laminates, is shifted to a vertical position, and therefrom detached from the overall fixture. The tilted stacking portion is now transformed to an upright transporting portion. Because the laminates remain stacked in this portion during transport, no clamping assembly needs to be assembled to the laminates in order to prevent displacement of the individual laminates. However, for safety purposes, an easy to fasten strap or tie-down may be applied to secure the laminates in the fixture in the event an accident or sudden jolt occurs during transport.

Referring now to FIG. 1, there is shown an exemplary fixture 10 for handling core laminates according to a preferred embodiment of the present invention. The fixture 10 is made of steel or structural steel and includes a base plate 12 and a stacking table 14. The stacking table 14 is also referred to as the main support member 14.

The stacking table 14 has two pivot arms 16 attached thereto, and the base plate 12 has two appendages 18 attached thereto. The appendages 18 have pins 20 disposed therein generally parallel to the horizontal axis of rotation A. The pivot arms 16 each have first ends 17 (see FIG. 4) configured to rotatably and removably attach to the hitch pins 20.

The stacking table 14 has a middle member 22 disposed generally perpendicular to the pivot arms 16. Support members 24 are integrally connected to the middle member 22. The support members 24 are disposed generally parallel to the horizontal axis of rotation A and generally perpendicular to the middle member 22. The support members 24 are disposed in a manner such that they combine to create a plane, against which the core laminates are stacked, that is generally perpendicular to the pivot arms 16 such that a right angle 23 is formed. The pivot arms 16 provide a static reactant force in a generally vertical direction. The support members 24 combine to provide a static reactant force in a generally horizontal direction. Together, these forces secure the laminates during stacking.

In an exemplary embodiment, the middle member 22 is a structural steel tube, and the support members 24 are structural steel channels. It should be appreciated that the above-described elements may be made of a material that is functionally equivalent to steel or structural steel, such as a composite. It should also be appreciated that various aspects of the exemplary embodiment illustrated in FIG. 1 may be altered without departing from the spirit and scope of this invention. For example, the support members 24 may be arranged parallel or diagonal to the middle member 22. The support members 24 may consist of varying shapes and sizes, and the number of support members 24 may also vary. Further, the support member 24 may be one solid piece that covers all or almost all of the stacking table 14.

Continuing with FIG. 1, an upper middle member 26 is shown as being removably attached to the middle member 22. The upper middle member 26 is a structural steel tube having a slightly larger cross-section than the middle member 22, whereas the upper middle member 26 slides over the middle member 22. The upper middle member 26 and the middle member 22 each have a hole 25 formed therein such that a hitch pin is placed therein and secured by a clip. Thus, fastening the upper middle member 26 onto the middle member 22. A transporting arm 28 is integrally connected to the upper middle member 26. For example, the transporting arm 28 may be welded to a location on the upper middle member 26. In an exemplary embodiment, openings 27 (see FIG. 2) are formed in the upper middle member 26, in which a portion of the transporting arm 28 located and secured therein. Transporting slots or holes 30 are formed in the transporting arm 28 to facilitate transportation of the core by a crane or lifting device (not shown). While FIG. 1 illustrates the slots or holes 30 as being formed in the transporting arm 28, it should be appreciated that the slots or holes 30 may be formed directly in the middle member 22 or directly in the upper middle member 26. It should also be appreciated that the transporting arm 28 may be connected directly to the middle member 22 or that the transporting arm 28 and the middle member 22 may be integrally formed from one piece of material that is functionally equivalent to steel or structural steel. Additionally, while FIG. 1 illustrates the transporting arm 28 as being substantially perpendicular to the middle member 22, the transporting arm 28 may be placed at an angle therein, according to design preferences.

Figure 2:
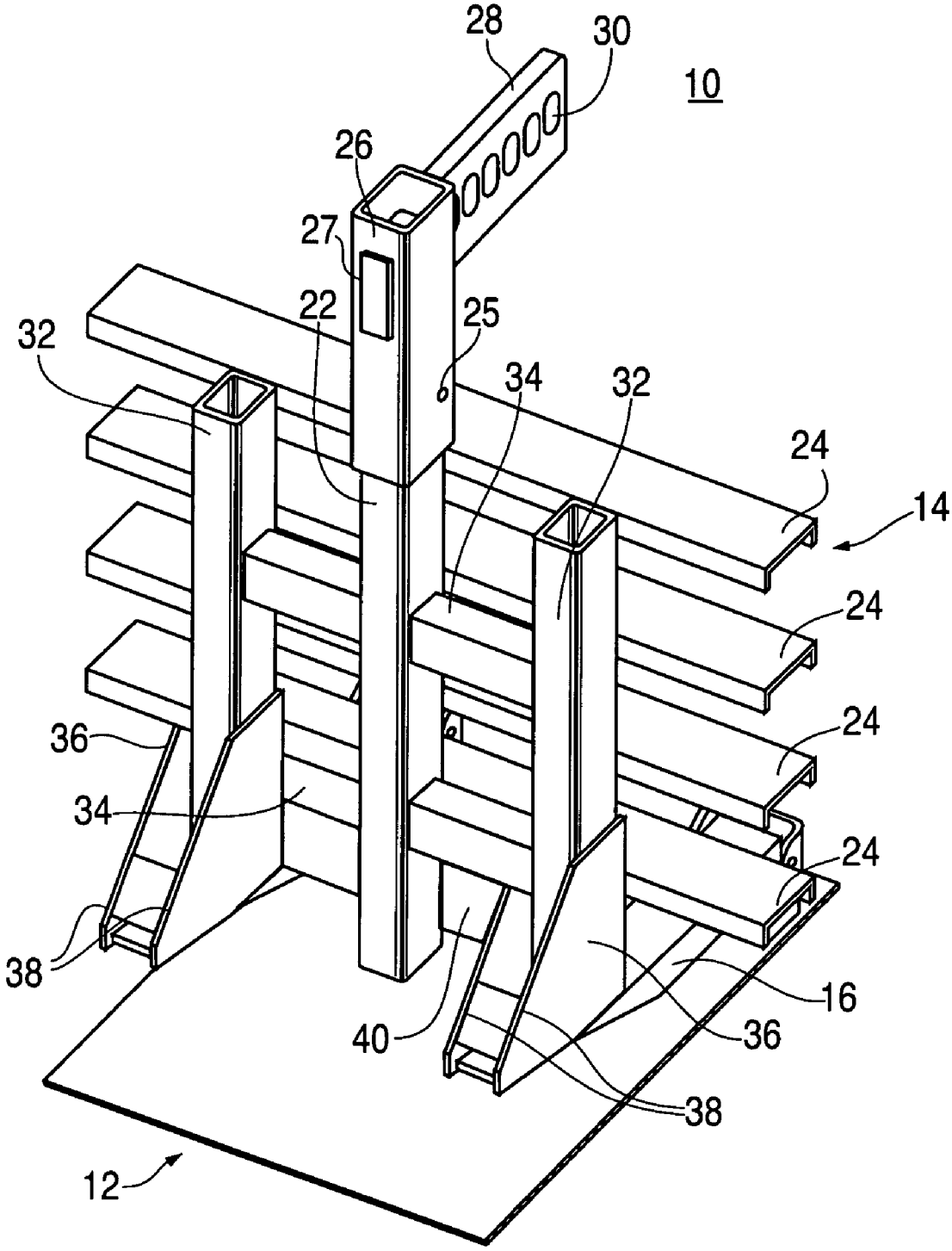
FIG. 2 is a another perspective view of the exemplary fixture of FIG. 1

Referring now to FIG. 2, a perspective rear view of fixture 10 is shown according to a preferred embodiment of the present invention. The stacking table 14 is supported, in large part, by two vertical members 32, two horizontal members 34, and two load distribution assemblies 36, all of which are illustrated in FIG. 2. It should be appreciated that one of ordinary skill in the art, having understood the inventive concepts described herein, may infinitely vary the combination of support members without departing from the spirit and scope of this invention. For example, the stacking table 14 may be supported by only one member or the stacking table 14 can be self-supporting.

In the exemplary embodiments described herein, the vertical members 32 are made of structural steel and are fixedly attached to the support members 24, the load distribution assemblies 36, and the pivot arms 16. For example, each support member 24 is welded to locations on the vertical members 32. Also welded to the vertical members 32, are the pivot arms 16 and the load distribution assemblies 36. It should be appreciated that fastening means other than welding can be used to connect the members 24, 32 and the assemblies 36. For example, they may be bolted to one another.

The horizontal members 34 are preferably made of structural steel and are fixedly attached to the middle member 22. In addition to the middle member 22, the horizontal members 34 are attached to either the vertical members 32 or the angled load distribution assemblies 36. For example, each horizontal member 34 is welded to locations on either the vertical members 32 or the angled load distribution assemblies 36. The horizontal members 34 may be welded to locations on the middle member 22 or may pass through openings correspondingly formed in the middle member 22. It should be appreciated that the horizontal members 34 may be attached to the vertical members 32 and the angled load distribution assemblies 36 in varying combinations and by varying means.

The fixture 10 has two angled load distribution assemblies 36. The load distribution assemblies 36 function to distribute the weight of the stacking table 14 throughout the distribution assemblies 36 themselves and the base plate 12. These angled load distribution assemblies 36 are located at the base of each vertical member 32. More specifically, the assemblies 36 are fixedly attached to the vertical members 32 at a location proximate to the location at which the vertical members 32 contact the pivot arms 16. The respective load distribution assemblies' 36 side plates 38 are fastened on opposite sides of the vertical members 32. The side plates 38 are fastened, for example, by bolting or welding them to the vertical members 32.

A lower spacer plate 40 is provided proximate to where the right angle 23 (see FIG. 1) is formed. For example, the lower spacer plate 40 may be attached to the fixture 10 at a location proximately above the pivot arms 16 and proximately in front of the vertical members 32. The lower plate 40 provides a flush surface against which laminates rest while stacking is effectuated. Because the fixture 10 accommodates varying sizes, shapes, and types of laminates, magnetic spacers (not shown) may be arranged on the spacer plate 40 and the support members 24 to ensure that the laminates remain level and so the weight of the laminates is evenly distributed.

Figure 3:
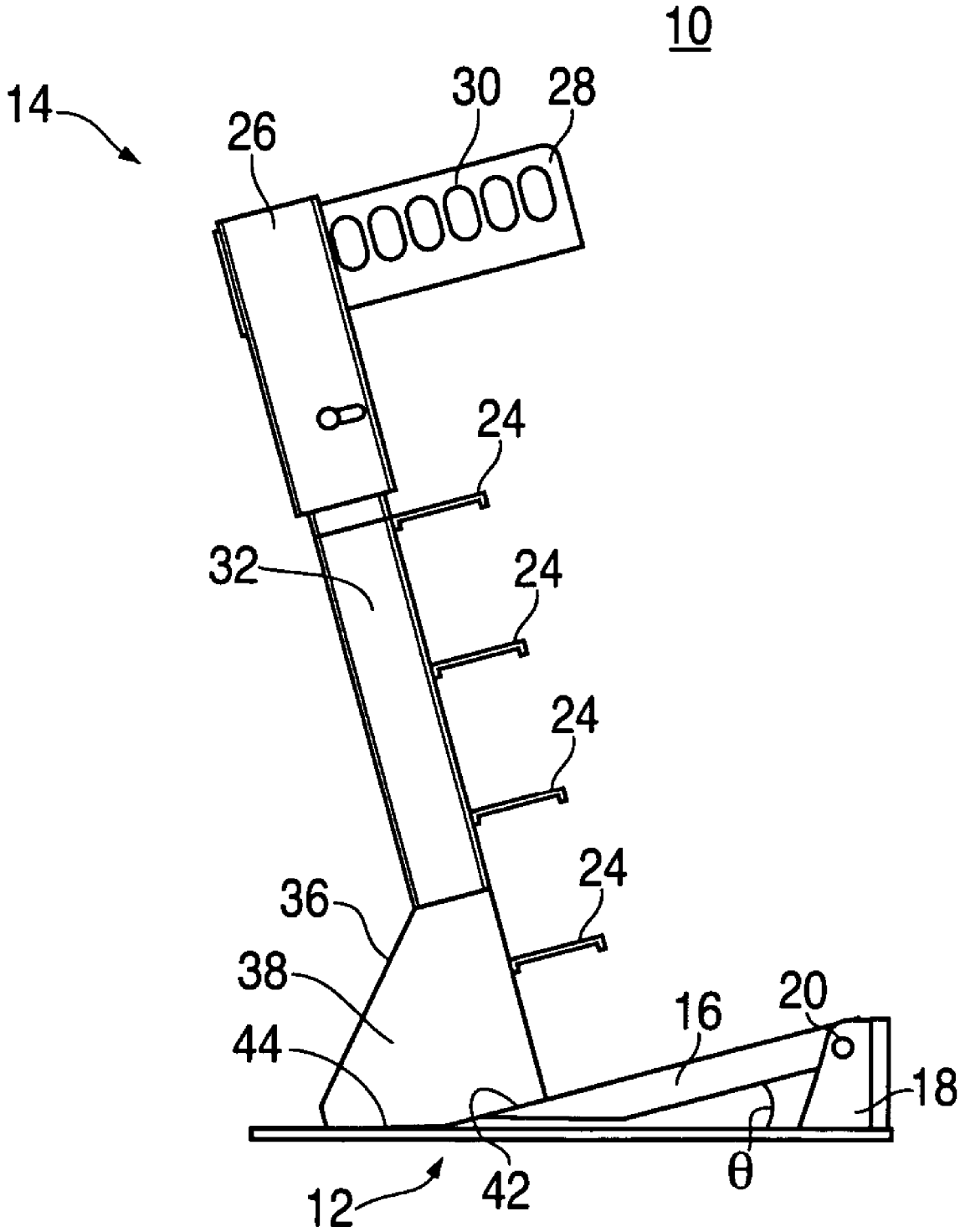
FIG. 3 illustrates a side view of the exemplary fixture of FIG. 1.

FIG. 3 illustrates a side view of the exemplary fixture 10 in a preferred stacking position. Because the pivot arms 16 are rotatably attached to the hitch pins 20, there exists an infinite number of positions in which the pivot arms 16 may be located relative to the base plate 12. The preferred stacking position is where the pivot arms 16 extend at an angle Φ relative to the base plate 12. The pivot arms 16 are beveled such that when Φ is achieved, they rest flush on the base plate 12. Also, the load distribution assemblies 36 are designed such that they rest flush with the base plate 12 when Φ is achieved. Preferably, Φ is approximately 15°.

Because the pivot arms 16 are integral members of the stacking table 14, when the arms 16 are rotated, the entire stacking table 14 is thereby rotated accordingly. Furthermore, because support members 24 are fixedly attached and arranged one above the other along the vertical members 32, such that they provide support for the laminates along a plane that is generally perpendicular to the pivot arms 16, when the pivot arms 16 are rotated by an angle Φ relative to the base plate 12, which is generally parallel to the horizon, the vertical members 32 and support members 24 are thereby rotated by an angle Φ relative to the plane that is generally perpendicular to the horizon. Resting the stacking table 14 at an angle Φ, enables gravity to secure the laminates against the support members 24 and the pivot arms 16, and thereby, the laminates can be stacked without additional support from securing devices, such as tie-downs, straps, and ropes.

The load distribution assemblies 36, each have two side plates 38, wherein the side plates 38 each have a bottom edge that has two portions 42, 44. Portions 42 are located proximate to the pivot arms 16. These portions 42 are generally parallel to, and overlap, the pivot arms 16. The other portions 44 generally are at an angle Φ from the bottom portions 42, and therefore, when the fixture 10 is in the preferred stacking position, as shown in FIG. 3, these portions 44 rest flush with the base plate 12. Portions 44 operate to help secure the stacking table 14 and distribute the stacking table's 14 weight throughout the base plate 12.

While the exemplary embodiment of FIG. 3 is described as having a preferred angle Φ of 15°, it should be appreciated that Φ is adjustable. For example, the distribution assemblies 36 and/or the pivot arms 16 may have adjustable feet attached thereto such that they vary the position of the stacking table 14 relative to the base plate 12 and thereby adjust Φ. It should also be appreciated that fixture 10 does not have fixed, non-adjustable, plates 38 that are manufactured to a specific Φ. Instead, the fixture has adjustable distribution assemblies 36. For example, portions 42 and 44 may be hinged together, wherein they are moveable relative to each other. This mobility enables users to alter Φ according to the type of laminates being stacked and based on other variables that may give rise to adjusting Φ. Furthermore, adjustments to Φ may be accomplished by other means. For example, lifting the stacking table 14 by means of an overhead crane or a hydraulic lift until the desired Φ is accomplished. Once the desired Φ is accomplished, it can be maintained by placing a spacer block between the stacking table 14 and the base plate 12.

Figure 4:
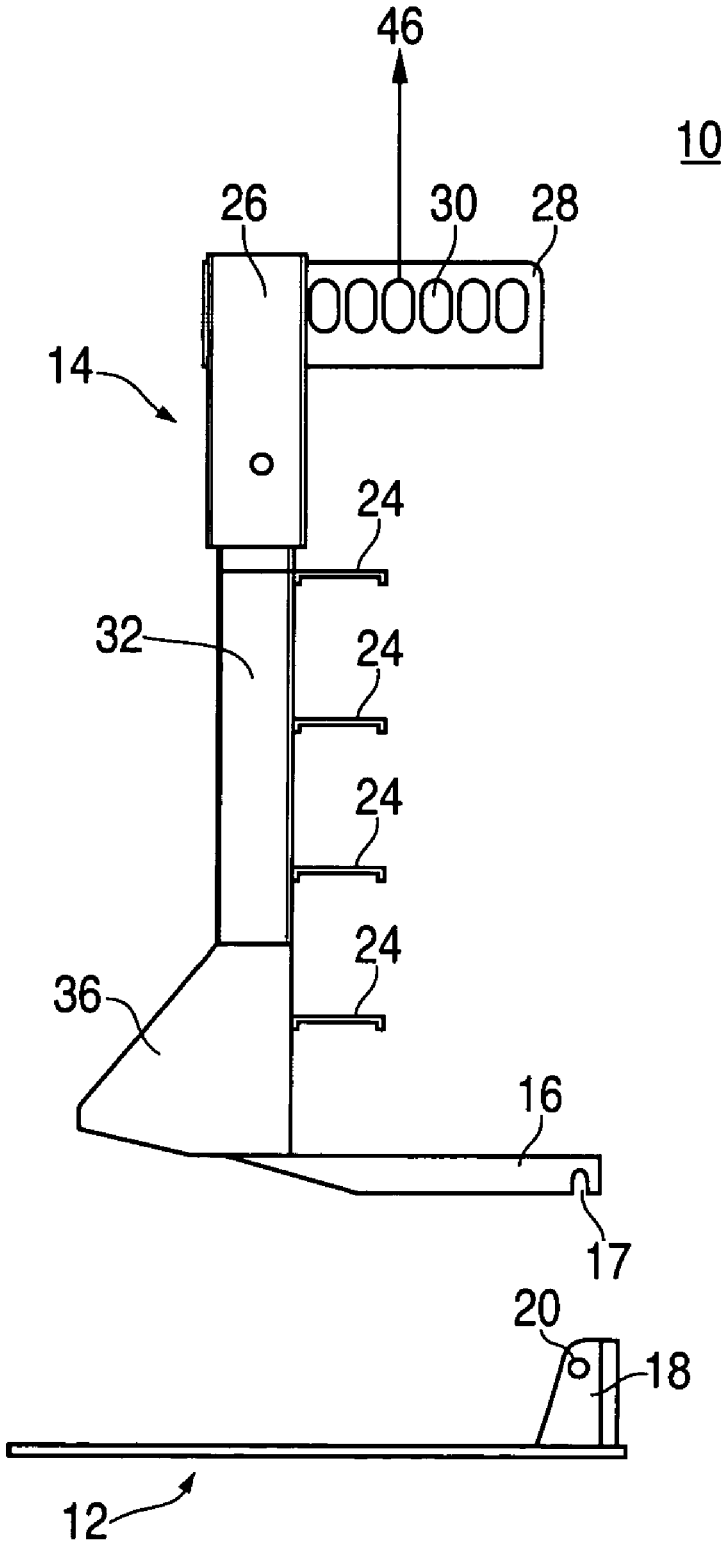
FIG. 4 illustrates a side view of the exemplary fixture of FIG. 1 in a transporting position.

FIG. 4 is a side view of fixture 10 according to a preferred embodiment of the present invention. FIG. 4 illustrates the stacking table 14 detached from the base plate 12. In order to achieve the detachment shown in FIG. 4, a transporting force 46 is attached and applied to one of the transporting slots or holes 30. When the force 46 is applied, the pivot arms 16 rotate about the horizontal axis of rotation A and eventually detach from the hitch pins 20, thereby completely detaching the stacking table 14 from the base plate 12.

The pivot arms 16 will remain approximately parallel to the horizon after the stacking table 14 detaches from the base plate 12, if the transporting force 46 is applied at the transporting slot 30 that corresponds with the stacking table's 14 center of gravity. Because the stacking table 14 is used to transport laminates and because the shape and weight of laminates vary, multiple slots or holes 30 are provided. Thus, making it possible to adjust the location of the transporting force 46 according to the varying center of gravity of the stacking table 14 having laminates stacked therein. An advantage to this arrangement is the stacked laminates can be transported without having a clamping assembly assembled to the stacked laminates in order to prevent the individual laminates from displacing during transport. For safety purposes, an easy to fasten strap or tie-down can be utilized to secure the laminates in the stacking table 14. The capability of transporting the laminates without first having to assemble a clamping assembly and then disassemble the clamping assembly after transport, provides for a more efficient manufacturing process.

It should be appreciated that the transporting force 46 is attached and applied at a transporting slot 30 located just beyond the stacking table's 14 center of gravity. Thus, when the table 14 detaches from the plate 12, the pivot arms 16 approach a position parallel to the horizon. However, the pivot arms 16 never become parallel to the horizon, and the stacking table 14 maintains a tilt from vertical similar to when it is attached to the base plate 12 and in the preferred stacking position. Because of this tilt from vertical, gravity utilizes the laminates' weight to create securing forces in both the horizontal and vertical directions. These horizontal and vertical forces secure the laminates in the fixture 10 despite opposing forces incurred during transporting, and therefore, no securing devices, such as straps, tie-downs or clamping assemblies of any kind are required during transporting.

Although an example of the fixture 10 is exemplified as a fixture for stacking and transporting laminates, it should be appreciated that the fixture can be used to accomplish other tasks. For example, the fixture is useful for handling materials other than reactor core laminates.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A fixture for handling laminates, comprising:

a base plate having at least one appendage extending therefrom;

at least one pivot arm extending from the at least one appendage, wherein the pivot arm has a first end and a second end, and the first end is rotatably and removably attached to the appendage to permit the pivot arm to move relative to the base plate;

a middle member having a transporting arm removably attached thereto, wherein the transporting arm extends generally perpendicular relative to the middle member and has a plurality of slots formed therein for connecting to a transporting device;

a first and a second vertical member disposed generally parallel to the middle member;

a first and a second horizontal member disposed generally perpendicular to the middle member; and a support member attached to the middle member, wherein the support member and the pivot arm operate to support the laminates.

2. The fixture of claim 1, wherein the transporting arm is integrally attached to an upper middle member, and the upper middle member slides over part of the middle member and is attached thereto.

3. The fixture of claim 1 wherein the support member comprises a plurality of channel structures attached to the first and the second vertical members and the middle member.

4. The fixture of claim 1 further comprising a support plate disposed where the first and the second vertical members connect to the pivot arm, wherein the support plate ensures a flush surface against which the laminates are stacked.

5. The fixture of claim 1, wherein the support member is movable at least between a transporting position and an assembling position.

6. The fixture of claim 5, wherein the support member is in the assembling position when the pivot arm extends at an angle Φ relative to the base plate.

7. The fixture of claim 6, wherein Φ is approximately 15°.

8. The fixture of claim 5, wherein the second end of the pivot arm is beveled at an angle Φ; and the support member is in the assembling position when the second end of the pivot arm contacts the base plate in a flush manner.

9. The fixture of claim 8, wherein Φ is approximately 15°.

10. The fixture of claim 5, wherein the support member is in the transporting position when the pivot arm extends generally parallel to the base plate.

11. The fixture of claim 5, wherein the support member is detachable from the appendage when the support member is in the transporting position.

* * * * *